US005187536A

United States Patent [19]

Hasegawa et al.

[11] Patent Number: 5,187,536

[45] Date of Patent: Feb. 16, 1993

[54] IMAGE FORMING APPARATUS

[75] Inventors: Takashi Hasegawa, Matsudo; Masahiro Inoue, Kawasaki, both of Japan

[73] Assignee: Canon Kabushiki Kaisha, Tokyo, Japan

[21] Appl. No.: 908,783

[22] Filed: Jul. 6, 1992

Related U.S. Application Data

[63] Continuation of Ser. No. 800,964, Dec. 2, 1991, abandoned.

[30] Foreign Application Priority Data

Nov. 30, 1990 [JP] Japan ..... 2-336568

[51] Int. Cl.[5] ..... G03G 15/01

[52] U.S. Cl. ..... 355/327; 355/271; 355/274

[58] Field of Search ..... 355/326, 327, 271, 273, 355/274; 430/126; 346/160, 160.1, 153.1, 157; 358/75, 300

[56] References Cited

U.S. PATENT DOCUMENTS 4,531,828 7/1985 Hoshino .
4,660,077 4/1987 Kawamura et al. ..... 358/75
4,809,037 2/1989 Sato ..... 346/157
4,887,101 12/1989 Hirose et al. ..... 346/157
5,041,877 8/1991 Matsumoto ..... 355/271

*Primary Examiner*—Richard L. Moses
*Attorney, Agent, or Firm*—Fitzpatrick, Cella, Harper & Scinto

[57] ABSTRACT

An image forming apparatus includes first and second image bearing members; movable carrying member for carrying a transfer material through a first transfer position for electrostatically transferring a first image from the first image bearing member to the transfer material and through a second transfer position, downstream of the first transfer position with respect to a movement direction of the carrying member, for electrostatically transferring a second image from the second image bearing member onto the transfer material; wherein the apparatus is operable in a first mode wherein the images are transferred onto the transfer material both at the first and second transfer positions and in a second mode wherein no image is transferred onto the transfer material at the first transfer position, and the image is transferred onto the transfer material at the second transfer position; wherein differences in surface potentials of the transfer material immediately before and after the transfer material passes through the first transfer position in the first mode and the second transfer position in the second mode, are substantially the same.

64 Claims, 12 Drawing Sheets

IMAGE FORMING APPARATUS

This application is a continuation of prior application, Ser. No. 07/800,964 filed Dec. 2, 1991, now abandoned.

FIELD OF THE INVENTION AND RELATED ART

The present invention relates to an image forming apparatus such as a color copying machine or a color printer of an electrophotographic type or an electrostatic recording type having plural image forming stations in which visualized images formed on photosensitive or insulative drums in the image forming stations are transferred in an overlying manner onto a transfer material on a transfer material carrying means movable along an endless path, such as an endless belt.

Various types of color image forming machines have been proposed. In one of them, the image forming station is provided for each of the colors of the developers, and the visualized images of the respective colors are formed on the respective image bearing members through a known image forming process. The images are sequentially transferred onto the transfer material onto the externally supplied image transfer member. They are simultaneously fixed so that a color images are provided. In this case, the transfer material is carried on a transfer material carrying member movable along an endless path so as to be fed to the image forming stations. The visualized image is transferred from the photosensitive drums in the image forming stations onto the transfer material.

Four image forming stations are provided, for example, and a transfer belt for heating the transfer material conveys through the image forming stations, carrying the transfer material. Each of the image forming stations is provided with an image bearing member in the form of a photosensitive drum. Around the photosensitive drum, there are provided a charger, an exposure device, a developing device, a transfer charger, a cleaner or the like, which are disposed in the order named in the direction of the rotation of the drum. The developing devices of the image forming stations contain magenta, cyan, yellow and black toners. Between a sheet feeding station and a first image forming station, there is an attraction charger for electrostatically attracting the transfer material on the transfer belt. The transfer material attracted on the transfer belt passes through the image forming stations to receive the toner image. The transfer material is then separated from the transfer belt. Then, the toner is fixed on the transfer material by the image fixing device. When the attraction charger applies the attraction charge to the transfer belt and the transfer material, the surface potential of the transfer material attenuate by the leakage of the charge applied thereto by attraction charger, on the way to the image forming station. This arises the following problems.

(1) Separation of the transfer material

When the attraction charge attenuates, the transfer material may be separated from the transfer belt, or it is inclined by the positional deviation under the smaller attraction force.

(2) Improper image transfer

A monochromatic mode operation (a mode in which one color image is transferred) is carried out under the same condition (the same transfer current or voltage), the surface potential of the transfer material immediately before the station is different if the station is different, due to the attenuation of the attraction charge. This results in the difference in the transfer efficiency. More particularly, the reduction of the transfer efficiency may result in an improper image transfer.

SUMMARY OF THE INVENTION

Accordingly, it is a principal object of the present invention to provide an image forming apparatus in which the deviation of the transfer material on the transfer material carrying means and the separation of the transfer material therefrom is prevented, by which the transfer material is stably conveyed by the conveying means.

It is another object of the present invention to provide an image forming apparatus in which the transfer material is carried on the transfer material conveying means always under good conditions.

It is a further object of the present invention to provide an image forming apparatus in which the improper transfer due to the reduction of the transfer efficiency does not occur.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the embodiments of the present invention will be described.

Figure 6:
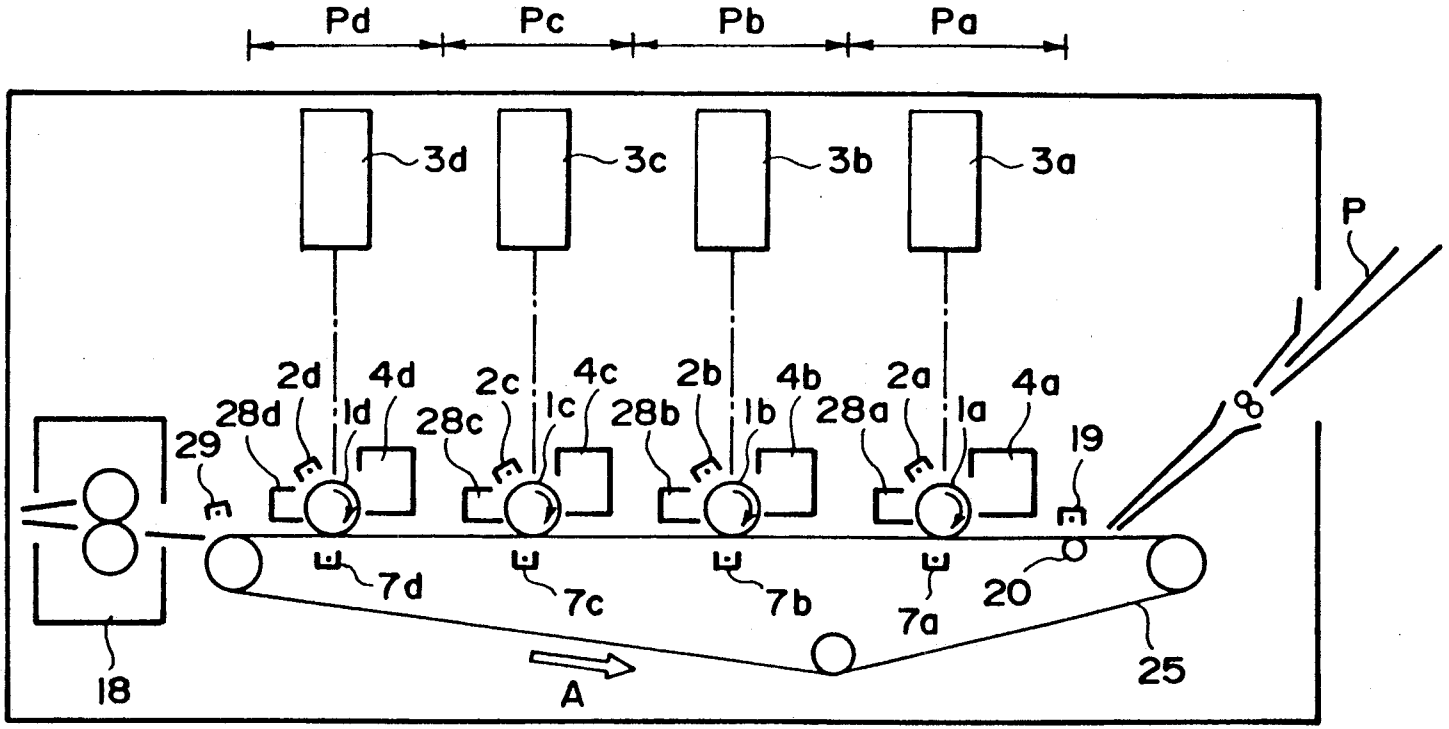
FIG. 6 is a sectional view of an example of a full-color copying machine of an electrophotographic type according to an embodiment of the present invention.

Referring first to FIG. 6, there is shown a full-color copying machine of an electrophotographic type as an exemplary image forming apparatus according to the present invention. The copying machine is provided with four image forming stations, i.e., first, second, third and fourth image forming stations Pa, Pb, Pc and Pd in the copying machine at one side, that is, at the right side in FIG. 6, there is a sheet feeding station, and at the opposite side, i.e., the left side of FIG. 6, there is an image fixing device 18. Below the passage from the sheet feeding station to the fixing device 18 in the copying machine, transfer material carrying means movable along an endless path in the form of a transfer belt 25, for example, is stretched between plural rollers in the manner known. The transfer belt 25 is driven in the direction indicated by an arrow A in FIG. 6 and carries thereon a transfer material P fed from the sheet feeding station. It supplies the transfer sheet P to the image forming stations Pa, Pb, Pc and Pd, sequentially.

The image forming stations Pa, Pb, Pc and Pd have substantially the same structure. It comprises an image bearing member in the form of a photosensitive drum 1*a*, 1*b*, 1*c* or 1*d* which is rotated in the direction indicated by an arrow. Around each of the photosensitive drums, there are provided a primary charger 2*a*, 2*b*, 2*c* or 2*d* for uniformly charging the associated photosensitive drum, a developing device 4*a*, 4*b*, 4*c* or 4*d* for developing the electrostatic latent image formed on the photosensitive drum, a transfer charger 7*a*, 7*b*, 7*c* or 7*d* for transferring the visualized image onto the transfer material P, a cleaner 28*a*, 28*b*, 28*c* and 28*d* for removing the toner remaining on the photosensitive drum. Above the photosensitive drum 1*a*, 1*b*, 1*c* or 1*d*, there is an image exposure device 3*a*, 3*b*, 3*c* or 3*d*.

The developing devices 4*a*, 4*b*, 4*c* and 4*d* contain magenta toner, cyan toner, yellow toner and black toner, respectively. Each of the image exposure devices 3*a*, 3*b*, 3*c* and 3*d*, in this embodiment, comprises a semiconductor laser, a polygonal mirror, an f-$\theta$ lens or the like, and functions to receive electric digital picture element signal, to produce a laser beam modulated in accordance with the signal. It projects the laser beam to the surface of the photosensitive drum to scan it in the direction of the generating line of the photosensitive drum between the primary charger 2*a*, 2*b*, 2*c* or 2*d* and the developing device 4*a*, 4*b*, 4*c* or 4*d*. To the image exposure device 3*a*, 3*b*, 3*c* and 3*d*, picture element signals corresponding to the magenta component of a color image, the picture element signal corresponding to the cyan component, the picture element signal corresponding to the yellow component and the picture element signal corresponding to the black component, are applied respectively. Between the first image forming station Pa and the sheet feeding station, an attraction charger 19 constituting the transfer material carrying means and a grounded metal roller 20 are disposed to face to each other with the belt 25 interposed therebetween. In order to assuredly attract the transfer material P supplied from the sheet feeding station onto the transfer belt 25, the corona discharge and the charge injection are carried out. The attraction charger may be disposed upstream of the transfer material supply position with respect to the direction of the belt movement.

On the other hand, between the fourth image forming station Pd and the fixing device 18, there is disposed a charge removing charger (discharger) 29. The discharger 29 is supplied with an AC voltage to assist separation of the transfer material P from the transfer belt 25.

In the color copying machine having the above structure, the transfer material P is guided by the sheet feeding guide and is fed onto the transfer belt 25. Then, the attraction charger 19 and the roller 20 cooperate to assuredly attract the transfer material P on the transfer belt 25. With the movement of the transfer belt 25 in the direction indicated by an arrow A in FIG. 6, a magenta image is formed on the photosensitive drum 1*a* in the first image forming station Pa; a cyan image is formed on the photosensitive drum 1*b* in the second image forming station Pb; an yellow image is formed on the photosensitive drum 1*c* in the third image forming station Pc; and a black image is formed on the photosensitive drum 1*d* in the fourth image forming station. While the transfer material P is conveyed to the fixing device 18 through the first-fourth image forming stations Pa-Pd, that is, through the first-fourth image transfer position where the transfer charger 7*a*-7*d* is faced to the photosensitive drum, these images are sequentially transferred superposedly on the transfer material P by the transfer chargers 7*a*, 7*b*, 7*c* and 7*d* of the image forming stations, so that a combined color image is formed. The transfer material P passes through the first image forming station Pd, and is discharged by the discharger 29 supplied with an AC voltage, and is separated from the transfer belt 25. The transfer material P separated from the transfer belt 25 is fed to the heat-fixing device 18, where the toner image transferred from the fixing device 18 are fused, mixed and fixed. Thereafter, the transfer material discharged through the transfer material outlet. Thus, one copying cycle is completed.

When the transfer material carrying means, that is, the transfer belt 25 is made of PET (polyethylene terephthalate), the volume resistivity thereof is $10^{17}$ ohm.cm. Table 1 below shows the output currents of the attraction charger 19 and the transfer chargers 7*a*-7*d* in the full-color copying operation when the PET transfer belt is used. The output current is the current applied to the charging electrode (wire electrode of the corona discharger) from the power source for supplying the electric power to the charger.

TABLE 1

| ATTRACTION CURRENT (μA) | TRANSFER CURRENT (μA) | | | |
|---|---|---|---|---|
| | 7a | 7b | 7c | 7d |
| 50 | 100 | 150 | 200 | 250 |

Figure 7:
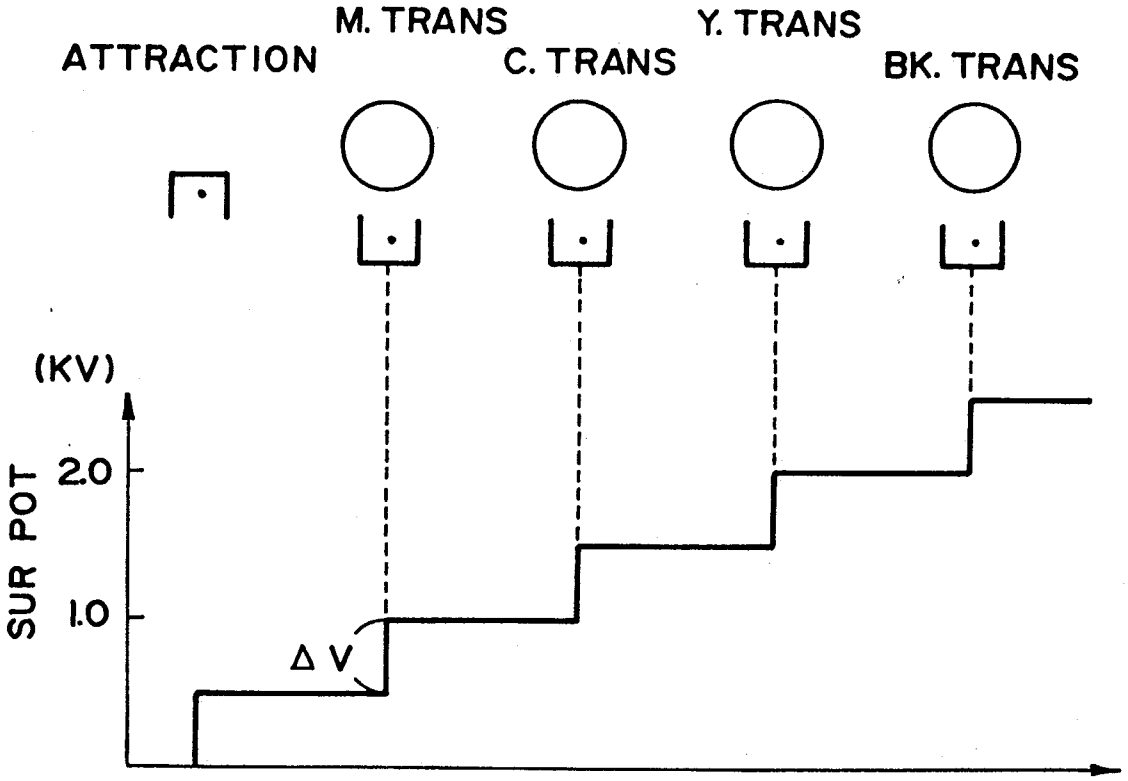
FIG. 7 shows characteristics of the surface potential change on the transfer material in a full-color mode operation, when PET transfer belt is used.

When the apparatus is operated with the current, the surface potential of the transfer material (paper) on the transfer belt 25 changes as shown in FIG. 7. Since the resistance of the transfer belt is high, the electric charge does not attenuate between the chargers, so that the potential changes smoothly with steps. The output currents are sequentially increased for the following reasons.

Figure 8A:
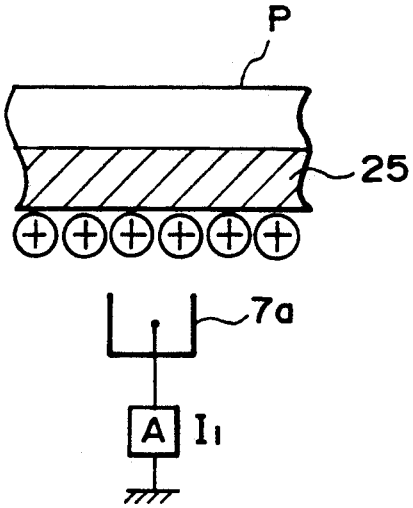
FIGS. 8A, 8B, 8C and 8D illustrate the reason for sequentially increasing the transfer charger potential.
Figure 8B:
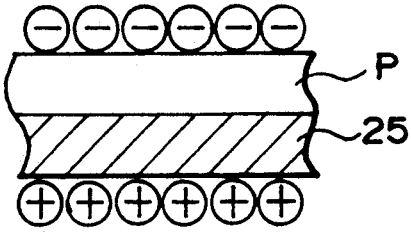

Referring to FIGS. 8A, 8B, 8C and 8D, this will be described. In FIG. 8A, there is shown a state when a positive charge is applied to the transfer belt 25 first at the first image forming station Pa. The output current of the transfer charger 7*a* is $I_1$. Simultaneously with this charging, toner particles, nitrogen or oxygen ions in the air are attracted to the surface of the transfer material P which is faced thereto, so that as shown in FIG. 8B, the positive charge applied to the transfer belt 25 is balanced therewith into a stabilized state. As described hereinbefore, the transfer belt 25 has the high volume resistivity, and therefore, the positive charge, the negative toner or ions in FIG. 8B hardly attenuate until it is subjected to the next charging.

Figure 8C:
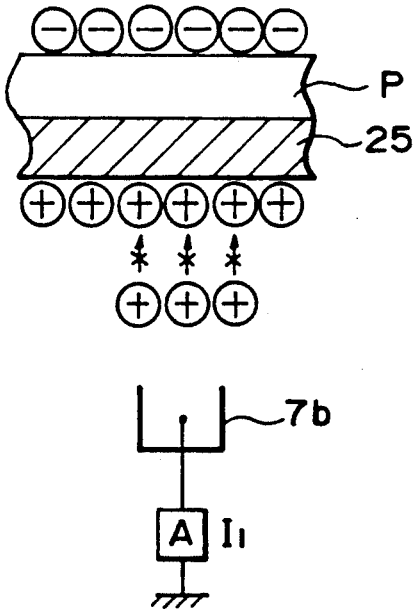
Figure 8D:
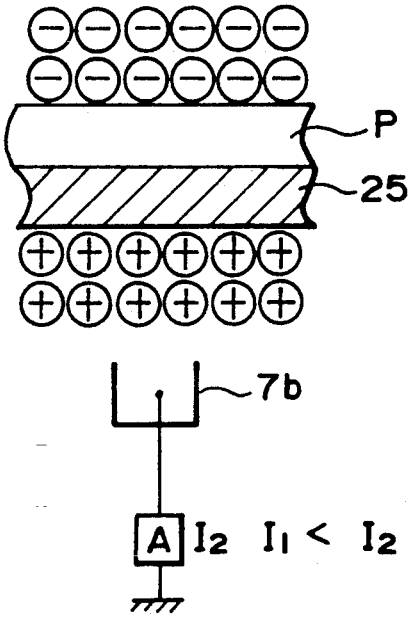

When the transfer belt is charged with the same output current $I_1$, by the next charging device *7b* in the second image forming station Pb, as shown in FIG. 8C, the positive electric charge provided by the previous charging functions as a barrier, so that the positive charge provided by the charger is hardly attracted by the transfer belt. In addition, the toner (negative) is hardly transferred onto the transfer material P. However, when as shown in FIG. 8D, the next charging is effected with an output current $I_2$ ($I_2 > I_1$), the positive charge is deposited on the transfer belt 25 beyond the barrier of the previous positive charge, and it is balanced with the toner (−) and the ions in the air into a stabilized state. That is, the good transfer operation is carried out.

As will be understood from FIG. 13 which will be described hereinafter, when the output current of the transfer charger is sequentially increased, it has empirically be found that it is preferable from the standpoint of the better transfer efficiency to satisfy:

$$\Delta V = 0.5\ KV$$

where ΔV is the potential change (the potential difference between immediately before and immediately after the transfer material passes through the image forming station).

The full-color copying machine has, in addition to the full-color mode (four color mode), the modes as shown in the Table 2 below. The modes are selectable by the operator manipulating the operation panel to produce proper signals.

TABLE 2

| MODES | | ORDER OF PROCESS M | C | Y | BK |
|---|---|---|---|---|---|
| FULL COLOR | | 1 | 2 | 3 | 4 |
| 3 COLORS | | 1 | 2 | 3 | |
| 2 COLORS | R | 1 | | 2 | |
| | G | | 1 | 2 | |
| | B | 1 | 2 | | |
| MONO | M | 1 | | | |
| | C | | 1 | | |
| | Y | | | 1 | |
| | BK | | | | 1 |

Figure 9:
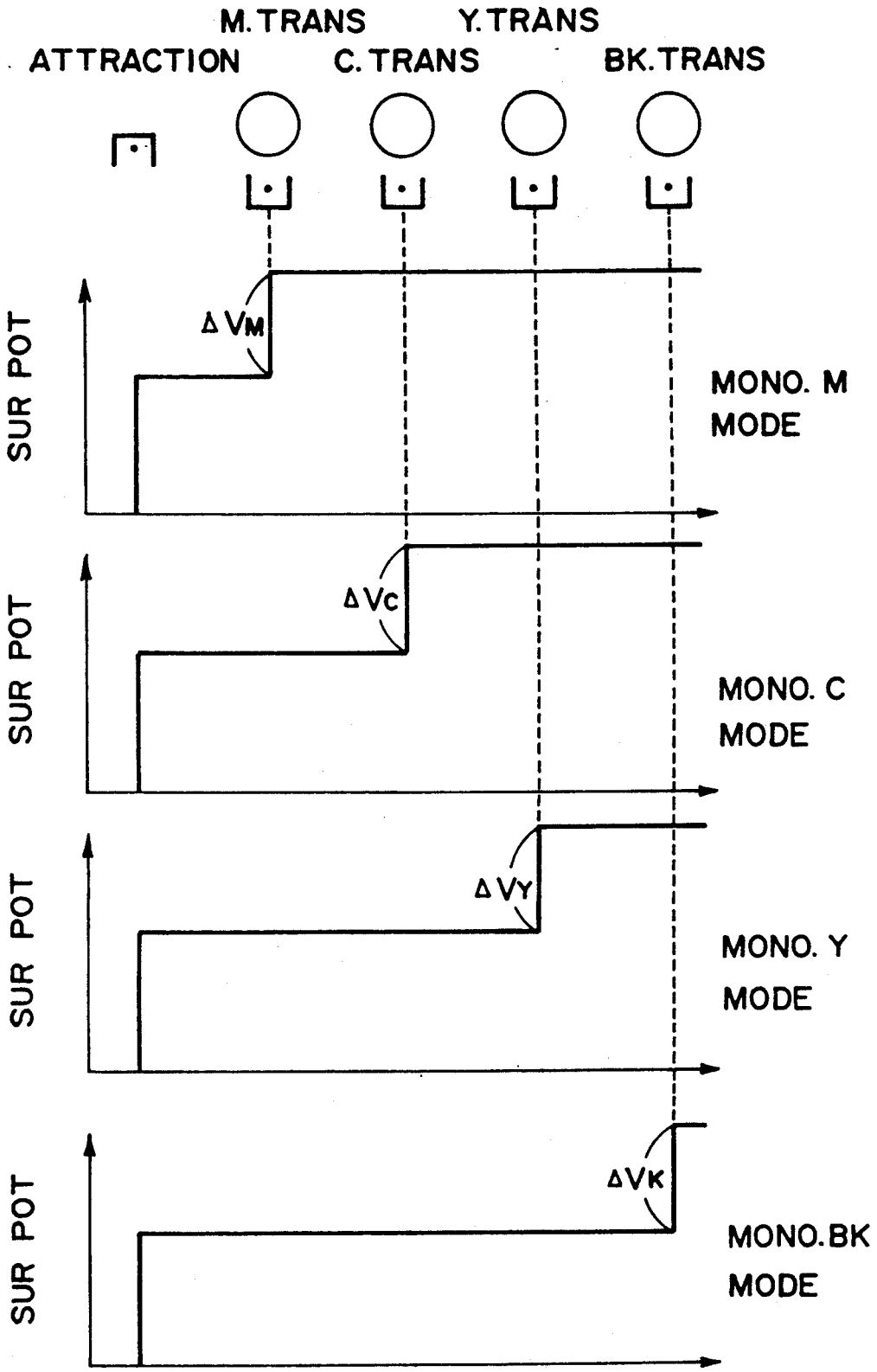
FIG. 9 shows characteristics of the surface potential change of the transfer material when each of monochromatic mode operations is carried out, when the transfer belt of PET is used in the copying apparatus of FIG. 6.

In these modes, the output of the attraction charger 19 and the transfer charger *7a–7d* are set in the following manner. The output of the attraction charger 19 is common to all of the modes including the full-color mode. The output of the transfer charger *7a–7d* in the monochromatic mode is the same as for the first color in the full-color mode; the outputs for the two color mode are the same as those for the first and second colors in the full-color mode; the ones for the three color mode are the same as those for the first, second and third colors in the full-color mode, for example, the change in the surface potential of the transfer material in the monochromatic mode is as shown in FIG. 9. The distance to the first operating station is different depending on the mode, but the potential difference ΔV is common to all of the monochromatic modes because the transfer belt made of PET material has such a high resistivity that the potential does not attenuate. No datum in Table 2 indicates no output of the transfer charger.

The description has been made in the foregoing with respect to the transfer belt made of PET. However, the belt having the high resistivity and therefore a high charge retaining property, is not easily discharged (charge removal), and therefore, the electric charge retains even after one rotation of the belt with the result of improper attraction, or it attracts the toner particles suspended in the apparatus. This may contaminate the apparatus or the transfer material. For these reasons, it is difficult to put the PET transfer belt into practice. It is therefore preferable that the volume resistivity of the transfer belt is $10^{10}$–$10^{15}$ ohm.cm. However, if such a transfer belt is used, and the outputs of the attraction chargers and the transfer chargers are selected on the basis of the outputs in the full-color mode operation so that the outputs are all the same in the monochromatic mode irrespective of the colors (magenta monochromatic, cyan monochromatic, yellow monochromatic or black monochromatic) from the standpoint of saving the capacity of the data memory or the like, the following problems arise. As described in the foregoing, the surface potential of the transfer material on the transfer belt attenuates due to the leakage of the electric charge applied by the attraction charger. This leads to the peeling-off of the transfer material or (2) improper image transfer. The description will be made as to these two problems.

The peeling-off of the transfer material will be first dealt with.

Figure 10:
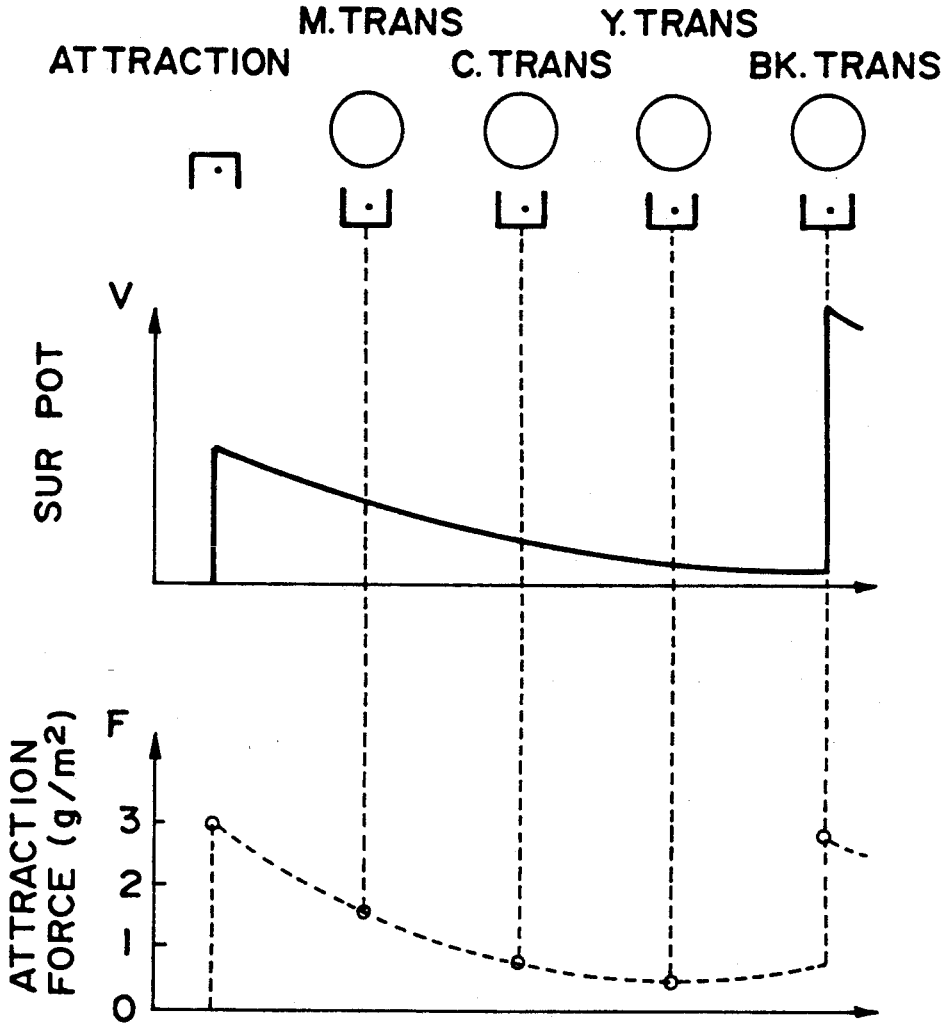
FIG. 10 shows characteristics of the change in the surface potential and the attraction force of the transfer material when single black color copy operation is carried out in the copying machine of FIG. 6.

FIG. 10 shows the change in the surface potential of the transfer material when a monochromatic black copy is produced, using a transfer belt having a volume resistivity of $10^{12}$ ohm.cm. It will be understood from this Figure that the electric charge applied by the attraction charger attenuates. The lower graph shows the results of measurement of the attraction force between the transfer material and the transfer belt after the attraction charge is applied by the attraction charger and after the transfer material passes through each of the image forming stations. It will be understood that the attraction force decreases gradually in accordance with the attenuation of the surface potential of the transfer material.

When the attraction force becomes lower than 1 g/cm$^2$, the transfer material is deviated. If it is lower than 0.5 g/cm$^2$, the transfer material is wrapped on the photosensitive drum, that is, it is separated or peeled off the transfer material carrying belt.

When the black monochromatic copies are continuously produced, only 60% of the copies were proper, but approximately 35% of the transfer sheets are inclined, and 5% were separated.

Figure 11:
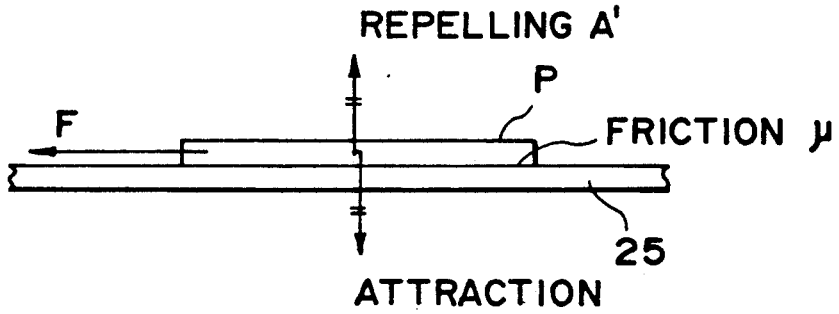
FIG. 11 illustrates the measuring method of the attraction force indicated in FIG. 10.

The attraction force was measured in the following manner. FIG. 11 shows a state wherein the transfer material having a size of 50×100 mm, in this example, is attracted on the transfer belt 25. The attraction force is indicated by a reference A. If the true force is to be known, the transfer material has to be pulled in the direction perpendicular to the attraction force, and the weight has to be measured. This is a cumbersome method of the measurement. Therefore, the attraction force are defined here as the weight at which the transfer material starts to move when the force F is applied to the transfer material P in the direction parallel with the surface. This is reasonable because, in the Figure, $F=\mu A'$, and $A'=A$, and therefore, the relative attraction force A can be determined if the force F is determined ($\mu$: friction coefficient).

Then, the improper image transfer will be described.

Figure 12:
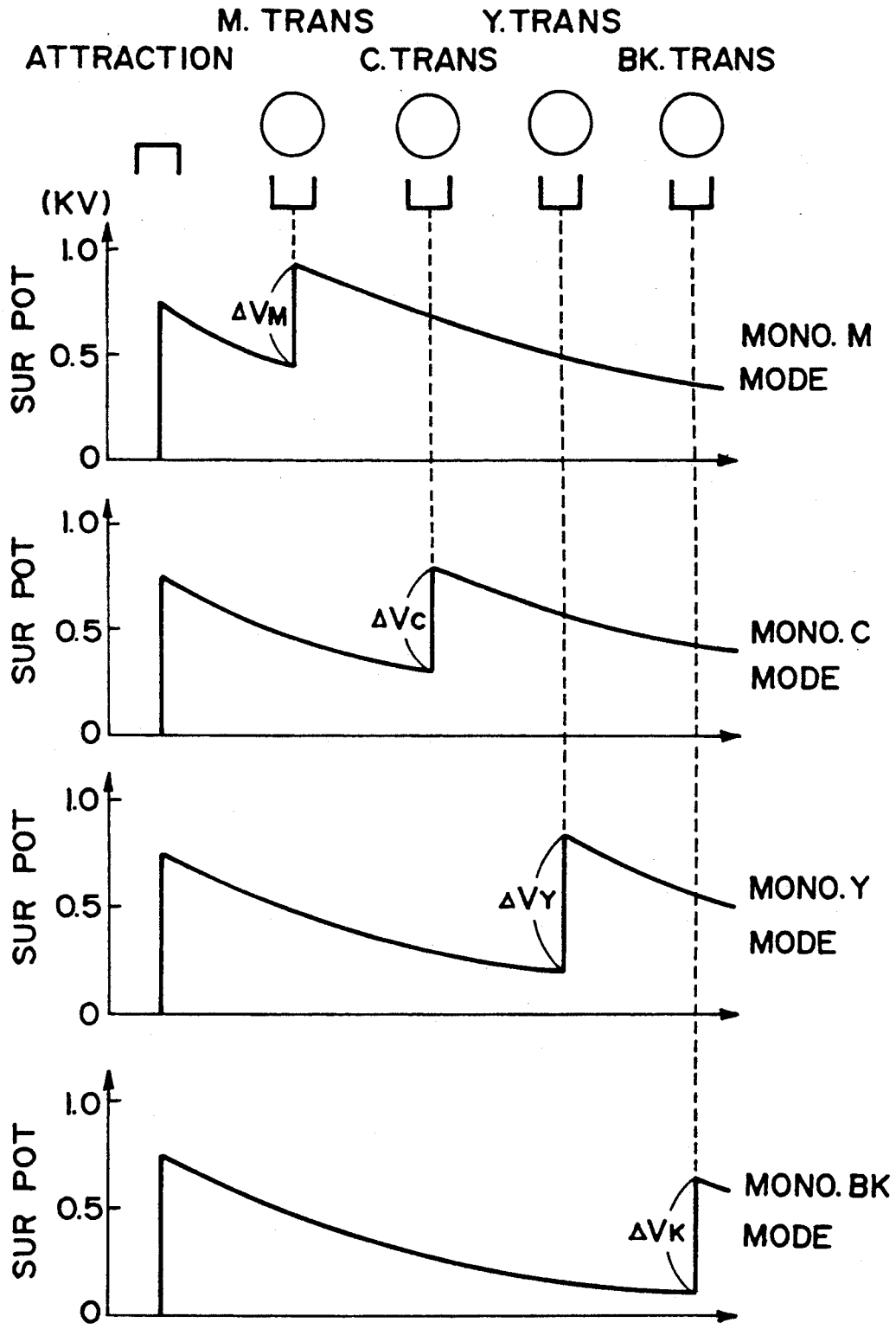
FIG. 12 shows characteristics of the transfer material surface potential change when each of monochromatic mode operations is performed in the copying machine.

FIG. 12 shows the results of measurements of the transfer material surface potential when monochromatic copies are produced for the respective colors, using the transfer belt having the volume resistivity of $10^{12}$ ohm.cm. The attraction charge current Iad=100 micro-ampere, the transfer charger current It=150 micro-ampere, and the transfer material is 80 g/cm$^2$ paper.

As will be understood from the graph of FIG. 12, because of the attenuation of the attraction charge, and because the electric current applied by the transfer charger is constant, the surface potential increase $\Delta V$ (the difference in the potentials immediately before and after the passage of the transfer material through the image forming station) satisfy:

$$\Delta V_M<\Delta V_C<\Delta V_Y<\Delta V_K.$$

While $\not\equiv V_M$ is approximately 0.5 KV which is proper, the different $\Delta VK$ is approximately 0.8 KV which is quite large.

Figure 13:
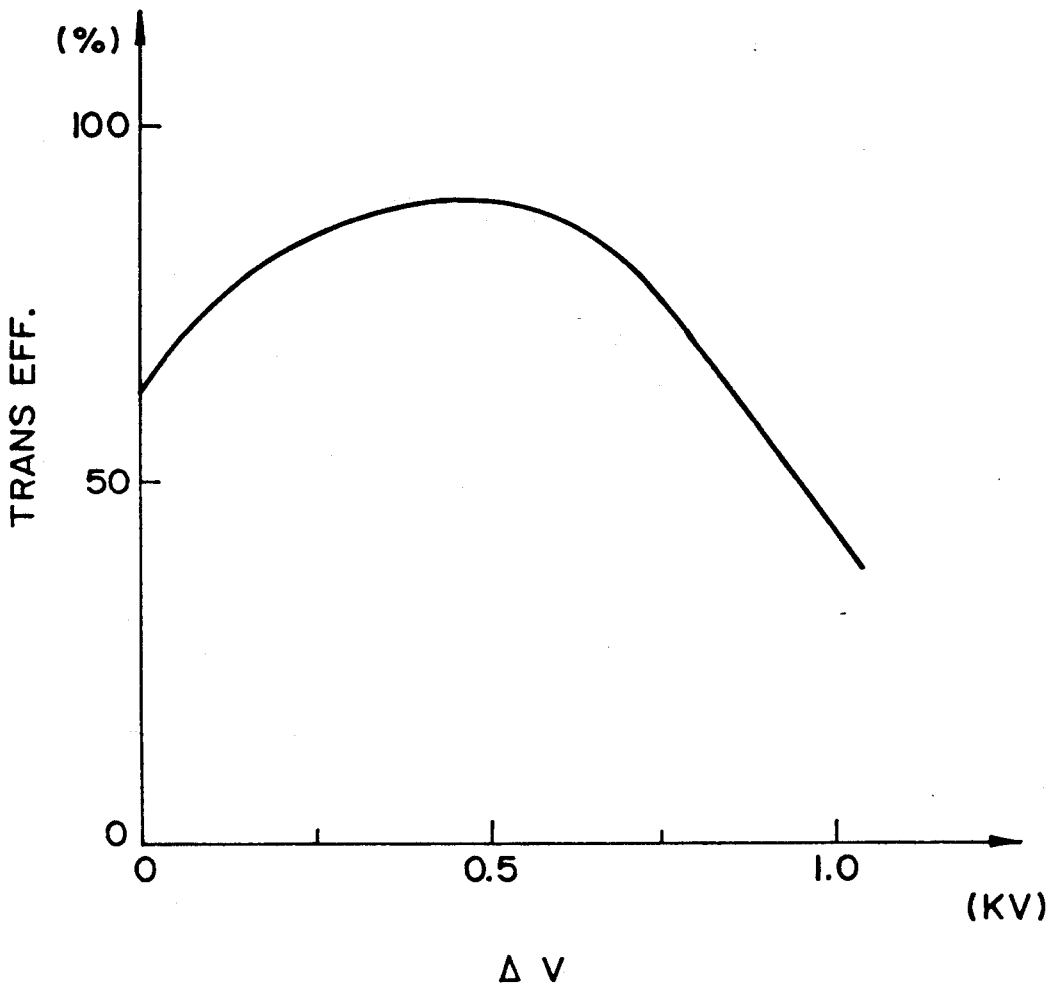
FIG. 13 shows the relation between the surface potential difference and the transfer efficiency.

FIG. 13 is a graph showing the relation between the potential difference $\Delta V$ and the transfer efficiency. The transfer efficiency has a peak at $\Delta V$=approximately 0.5 KV, and the level thereof is approximately 90% If the potential difference $\Delta V$ increases more, the air gap electric field between the transfer material and the toner increases with the result that the electric charge starts in the air gap, so that the effective electric field is not provided. Then, the transfer efficiency gradually decreases to such an extent that the improper image transfer occurs.

Accordingly, it is preferable to set proper output of the transfer charging means and the proper output of the charging means for charging the transfer material before the image transfer, such as the attraction charger, so that the transfer material is always attracted on the transfer material carrying means irrespective of the volume resistivity of the transfer material carrying means, without the peeling or the inclination of the transfer material and without the improper image transfer. The description will be made as to this point.

The outputs of the attraction chargers are changed in accordance with the modes so that when a monochromatic mode operation is effected, the transfer material surface potential difference $\Delta V$ immediately before and immediately after the passage of the first image transfer station (Table 2) where the image forming operation is first carried out as required by the color of the monochromatic mode, is substantially constant. In addition, the transfer current for the first color is common to all of the monochromatic modes. This is the first embodiment of the present invention.

Table 3 below shows the outputs of the attraction chargers and the transfer chargers in various modes. In this Table, the absence of the transfer current value means non-actuation of the transfer charger.

TABLE 3

| FIRST STATION | MODES | ATTRACTION CURRENT ($\mu$A) | ORDER OF PROCESS ($\mu$A) M | C | Y | BK |
|---|---|---|---|---|---|---|
| M | FULL COLOR | 100 | 150 | 200 | 250 | 300 |
| | 3 COLORS | | 150 | 200 | 250 | — |
| | 2 COLORS (B) | | 150 | 200 | — | — |
| | (R) | | 150 | — | 180 | — |
| | MONO (M) | | 150 | — | — | — |
| C | 2 COLORS (G) | 130 | — | 150 | 200 | — |
| | MONO (C) | | — | 150 | — | — |
| Y | MONO (Y) | 150 | — | — | 150 | — |
| BK | MONO (M) | 170 | — | — | — | 150 |

For the purpose of simple explanation, the description will be made for each of the monochromatic modes, that is magenta M, cyan C, yellow Y or black BK monochromatic mode. As will be understood from Table 3, the output current in the attraction charging increases with the increase of the distance, depending on the selected mode, between the charging position where the attraction charger applies the electric charge to the transfer belt to the first image forming station where the image is first formed on the transfer material. On the other hand, the transfer current is common to all of the monochromatic modes (150 micro-amperes).

Figure 1:
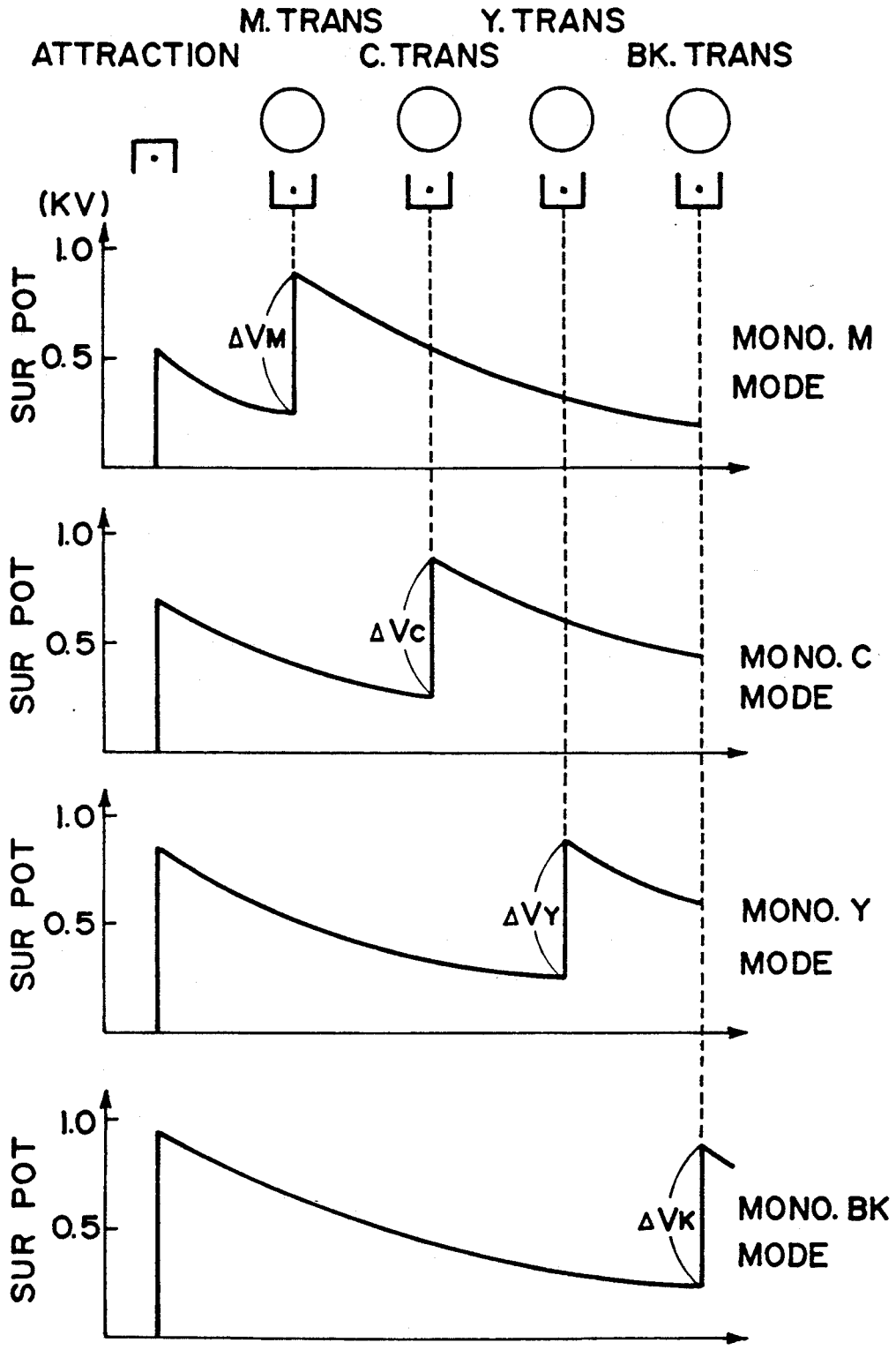
FIG. 1 shows the change in the surface potential of the transfer material in each of the monochromatic mode operation in an image forming apparatus according to a first embodiment of the present invention.

FIG. 1 shows the change of the surface potential of the transfer material in each of the monochromatic modes. In each of the monochromatic modes, the attraction charge is controlled in consideration of the attenuation of the potential. Therefore, the transfer material surface potential immediately before entering the first image forming station is substantially constant at approximately 0.25 KV. Since the current applied by the transfer charging is constant, the potential differences satisfy:

$$\Delta V_M=\Delta V_C=\Delta V_Y=\Delta V_K$$

It will be understood, the transfer action is proper and stabilized. Here, the potential differences $\Delta V$, as shown in FIG. 13 does not influence the transfer efficiency if it is approximately 100 V, and therefore, the variation of 100 V is generally tolerable.

In this embodiment, the transfer belt is made of polycarbonate film having the volume resistivity of $10^{10}$ ohm.cm in which carbon is dispersed (the thickness if approximately 200 microns).

Since the attenuation of the potential has a lot to do with the volume resistivity, the settings of the attraction currents of Table 3 is preferably determined in accordance with the volume resistivities of the transfer belt.

For example, when the magenta monochromatic mode in which the transfer material is subjected to the transfer operation in the first transfer station but is not subjected to the transfer operation in the second transfer station, is compared with the cyan monochromatic mode in which the transfer material is not subjected to the transfer operation in the first transfer station but the transfer material is subjected to the transfer operation in the second transfer position, the output current of the attraction charger in the former case is approximately 100 micro-amperes, whereas in the latter case it is 130 micro-amperes. The attraction current 100 micro-amperes in the two color (B) mode in which the transfer material is subjected to the image transfer operations in the first and second transfer stations, is different from that in the monochromatic mode, 130 micro-amperes. As will be understood from FIG. 1, with the increase of the distance from the attraction charging position to the first transfer position, the attenuation of the transfer material surface potential increases with the result of smaller attraction force between the transfer material and the transfer belt. To obviate this to prevent the separation of the transfer material from the transfer belt, the output of the attraction charger is increased. On the other hand, the attenuation of the surface potential of the transfer material decreases with the decrease of the distance from the attraction charging position to the first image transfer position, and if the output of the attraction charger is too large, the transfer efficiency influenced by the surface potential of the transfer material decreases, and therefore, the output of the attraction charger is decreased with the decrease of the distance between the attraction charging position to the first transfer position.

As regards the level of the potential difference ΔV, it is preferably 0.5 KV when the transfer material is a sheet of paper having a basis weight of 80 g/m$^2$, as will be empirically known. However, when a thick sheet or projection transparent film are used, it is preferably changed, and therefore, the potential difference level is not limiting to the present invention.

A second embodiment will be described in which the outputs of the attraction chargers and the transfer chargers are changed from those given in Table 3. In this embodiment, the outputs of the attraction chargers during the attraction operation are common, but the outputs of the first color transfer charger in the respective monochromatic modes is changed, so that the transfer material surface potential difference ΔV immediately before and immediately after the passage of the transfer material of the first station (Table 2) determined by the mode selected, is substantially constant.

Table 4 below shows the outputs of the attraction chargers and transfer chargers in the respective modes in the second embodiment.

TABLE 4

| FIRST STATION | MODES | | ATTRACTION CURRENT (μA) | ORDER OF PROCESS (μA) M | C | Y | BK |
|---|---|---|---|---|---|---|---|
| M | FULL COLOR | | 200 | 250 | 300 | 350 | 400 |
| | 3 COLORS | | | 250 | 300 | 350 | — |
| | 2 COLORS | (B) | | 250 | 300 | — | — |
| | | (R) | | 250 | — | 380 | — |
| | MONO | (M) | | 250 | — | — | — |
| C | 2 COLORS | (G) | 200 | — | 200 | 250 | — |
| | MONO | (C) | | — | 200 | — | — |
| Y | MONO | (Y) | 200 | — | — | 150 | — |
| BK | MONO | (M) | 200 | — | — | — | 100 |

For the purpose of simple explanation, the description will be made with respect to the respective monochromatic modes, i.e., magenta M mode, cyan C mode, yellow Y mode and black BK mode. As will be understood from Table 4, the output of the attraction chargers are common to all of the modes, that is, 200 micro-amperes. This is determined on the basis of the level required in the black monochromatic mode in which the distance between the attraction charging position to the first image forming operation position is the longest, and therefore, the peeling of the transfer material is most likely. As regards the output currents of the transfer chargers, they are different depending on the colors. For example, in the magenta monochromatic mode, it is 250 micro-amperes, and in the black monochromatic mode, it is 100 micro-amperes. Thus, the output current settings decreases with the increase of the distance from the attraction charging position and the first image forming position.

Figure 2:
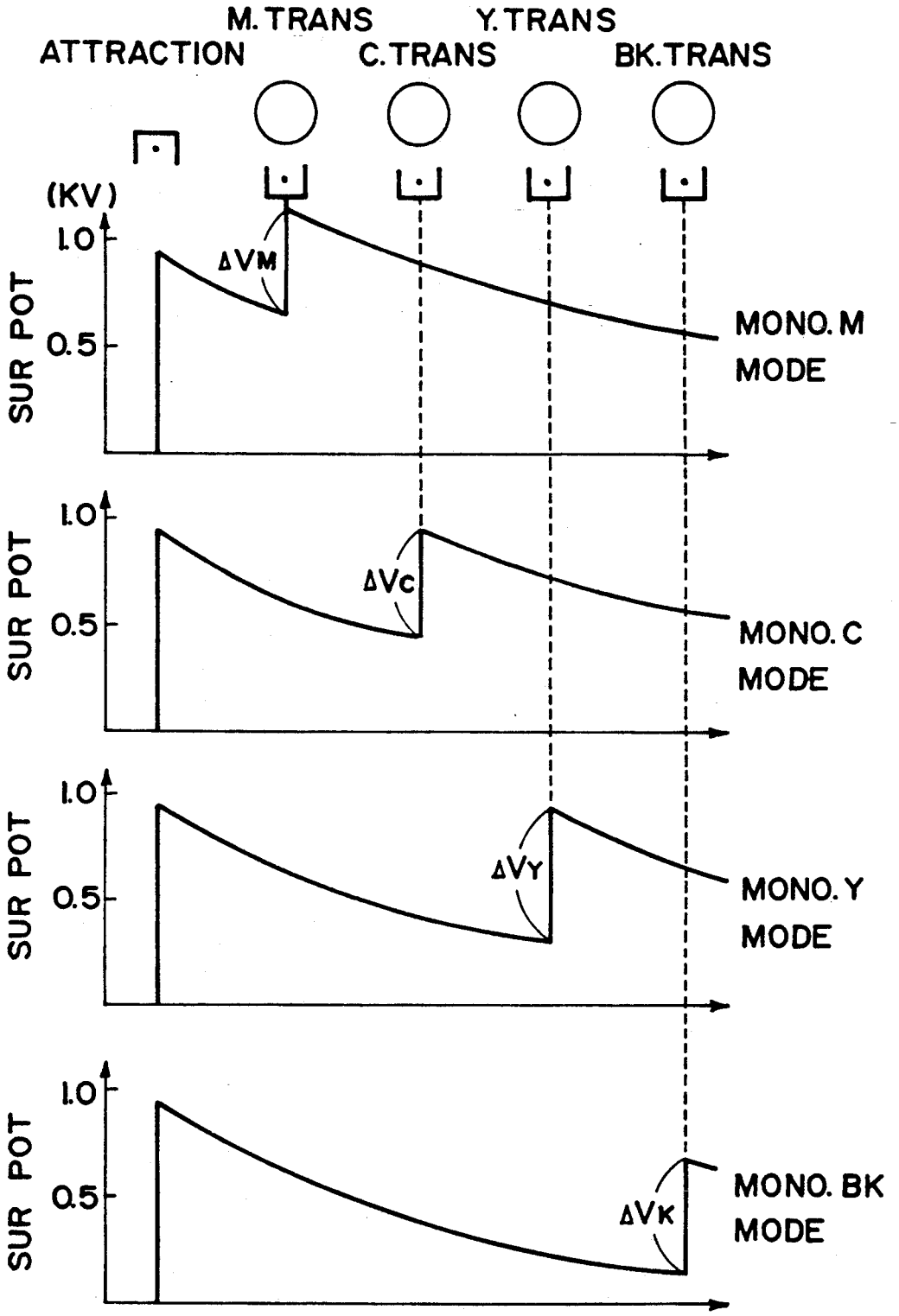
FIG. 2 shows a change in the surface potential of the transfer material in each of the monochromatic mode operations in an image forming apparatus according to a second embodiment of the present invention.

Referring to FIG. 2, the change in the transfer material surface potential is shown in the monochromatic modes.

The transfer output current at the first transfer station (magenta image forming station) in the two color (B) mode in which the transfer material is subjected to the image transfer operations in the first and second image forming stations, is 250 micro-ampere, which is the transfer output current at the second transfer position (cyan color image forming station) in a cyan monochromatic mode wherein the transfer material is not subjected to the image transfer operation in the first image forming station but is subjected to the image transfer operation in the second image forming station, i.e., 200 micro-amperes.

As shown in FIG. 2, with the decrease of the distance between the attraction charging position to the first image transfer operation, the attenuation of the transfer material surface potential to the first transfer position decreases, and therefore, the transfer current at the first image forming operation is increased therewith so as to avoid the decrease of the transfer efficiency.

As will be understood from FIG. 2, the surface potential of the transfer material provided by the attraction chargers in the monochromatic modes is the same, but the surface potential of the transfer material immediately before entering the first image forming station where the image forming operation is first carried out, is different. However, since the transfer current is selected for each of the modes, and therefore, the potential difference ΔV satisfy:

$$\Delta V_M = \Delta V_C = \Delta V_Y = V_K$$

Therefore, the image transfer operation is stabilized and proper.

The description will be made as to a third embodiment in which the first and second embodiments are used. When the resistivity of the transfer belt material and the resistivity of the transfer material are strongly dependent on the ambient conditions, or when the materials of the transfer materials widely change, it would be possible that one table (attraction current and transfer current) shown in the first or second embodiment is not enough.

Figure 3:
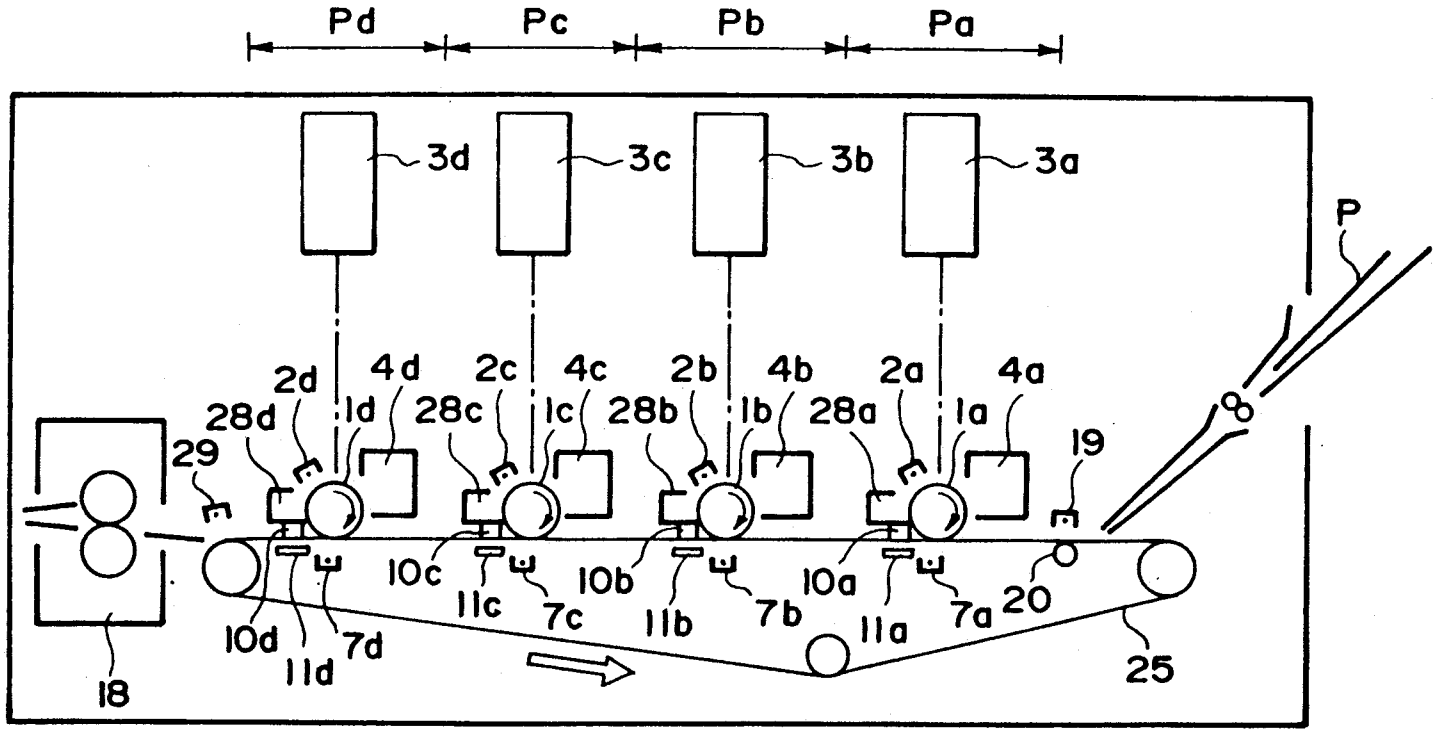
FIG. 3 is a sectional view of an image forming apparatus according to a third embodiment of the present invention.

In view of this, this embodiment is such that as shown in FIG. 3, surface potential sensors 10a–10d are disposed immediately after the respective image forming stations Pa–Pd. In response to the outputs of the sensors, the potential control is performed at a constant intervals to provide the proper surface potential by controlling the attraction charger current and/or the transfer charger current.

As for an example of this embodiment, the structure of the first embodiment is further improved. In the first embodiment, the attraction charger output current is changed to provide a constant transfer material surface potential immediately before the first operating image forming station, and the transfer charger output current for the first color is constant in all of the modes, thus the transfer material is properly conveyed and is subjected to the proper image transfer operation.

Grounded plates 11a–11d are disposed opposed to the surface potential sensors 10a–10d, respectively with the transfer belt 25 therebetween. The other structures are the same as in FIG. 6, and the detailed description thereof is omitted for simplicity.

Generally speaking, the volume resistivity of paper decreases approximately by two orders when it is placed under the high temperature and high humidity conditions (30° C. and 80%, for example) than when it is placed under the normal temperature and normal humidity conditions (23° C. and 60%, for example). When it is placed under the low temperature and low humidity condition (15° C. and 10%, for example), the volume resistivity is larger by approximately two orders than when it is placed under the normal conditions. With respect to the transfer belt, the amount of moisture deposited on the face thereof changes, and therefore, the volume resistivity of the transfer belt also changes.

When the changeable range of the ambient conditions in which the apparatus is placed or when the materials of the used transfer materials are widely different, the control is difficult with the constant attraction current output and the transfer current output.

Figure 4:
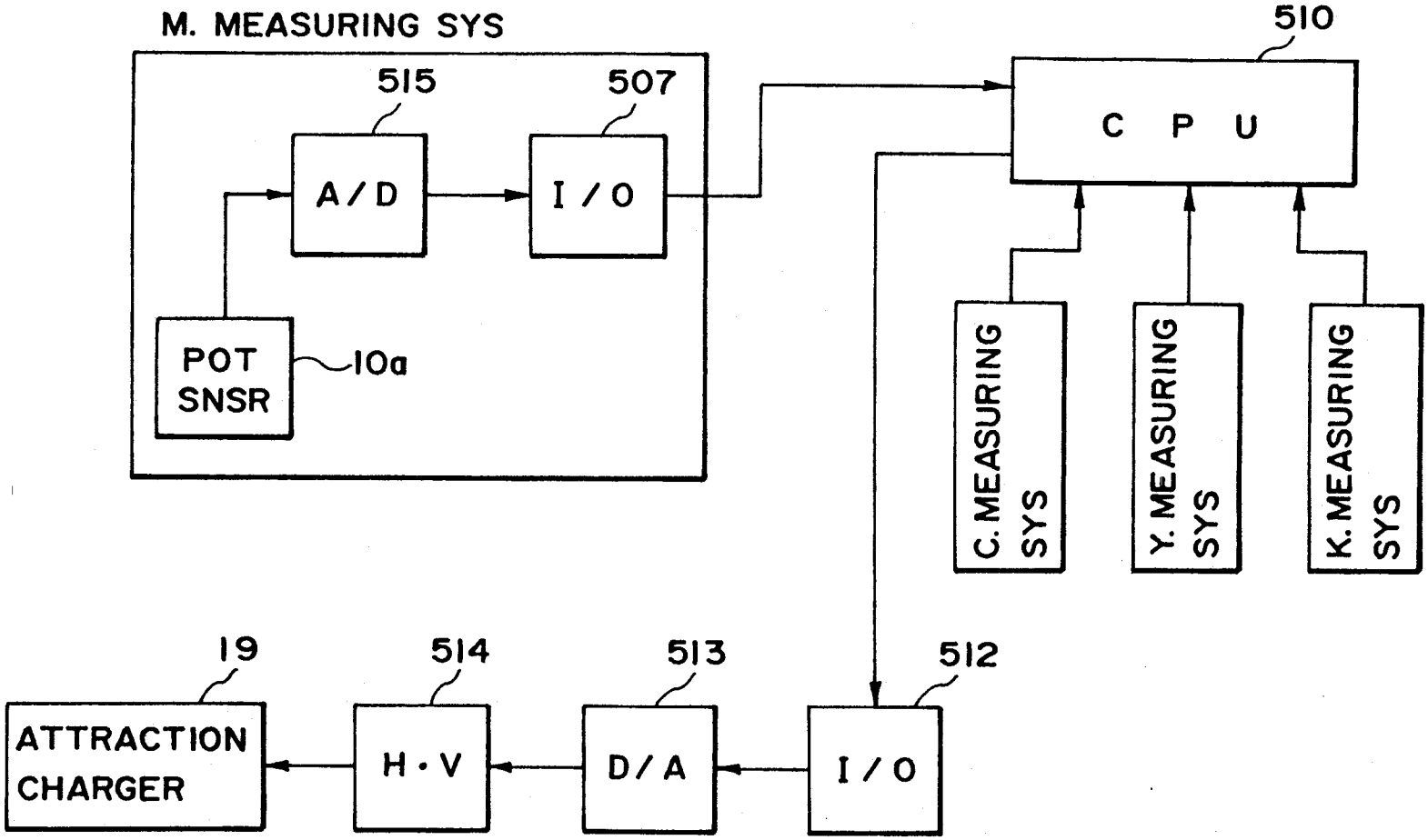
FIG. 4 is a block diagram of a control circuit structure used in the image forming apparatus of FIG. 3.
Figure 5:
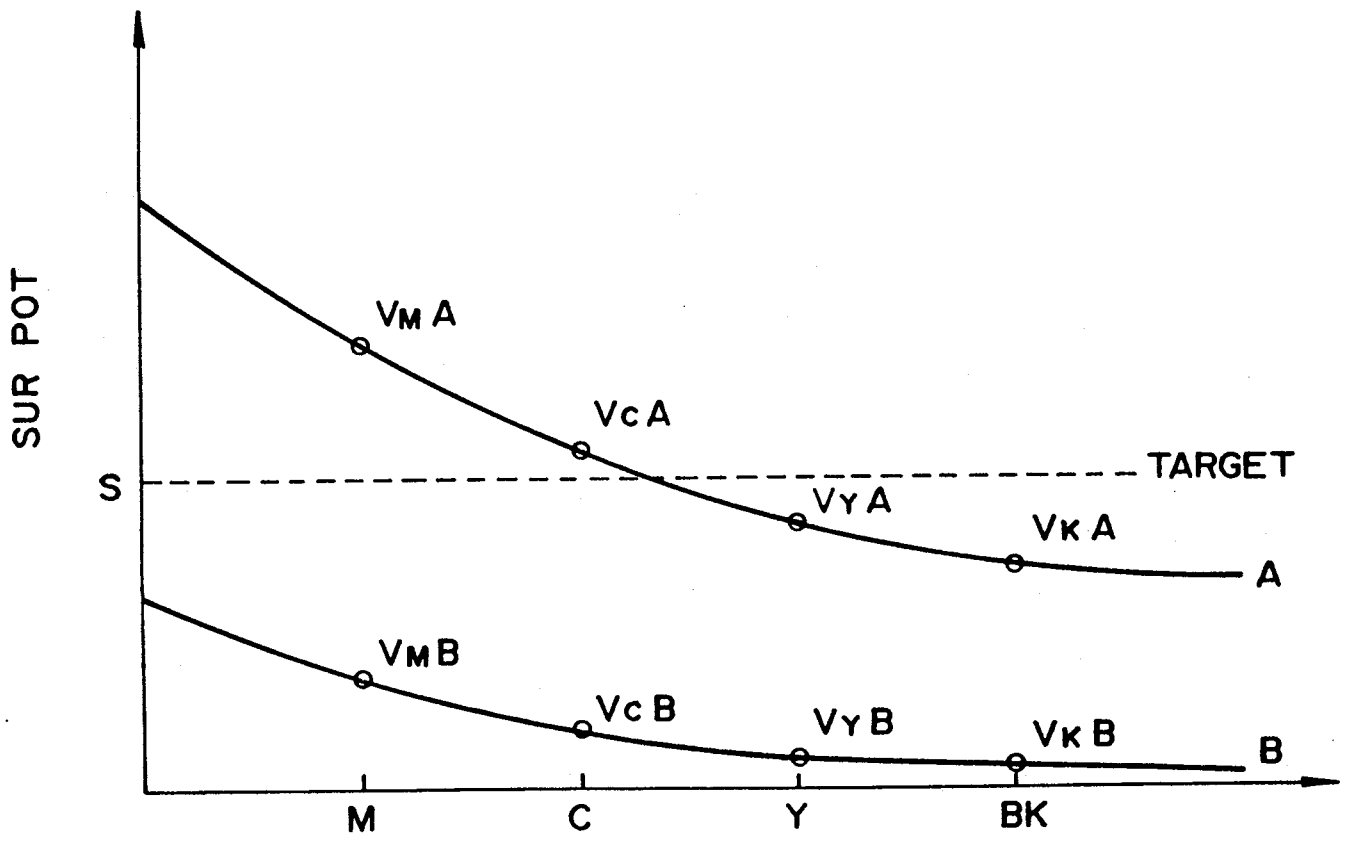
FIG. 5 shows the characteristics of the potential control in the apparatus of FIG. 3.

FIG. 4 is a block diagram of the control circuit used in this embodiment. The potential sensors 10a–10d provided for the magenta color, cyan color, yellow color and black colors, respectively, have the same structure, and therefore, the structure for the measuring system for the magenta color is shown in FIG. 4 as a representative. The output of the potential sensor is converted to a digital signal by the analog-digital converter 515, and the signal is supplied to a CPU 510 effect the operation for the potential control on the basis of the signal. It determines the attraction charger output x, y, z and w for the respective modes, as shown in FIG. 5.

TABLE 5

| FIRST STATION | MODES | | ATTRACTION CURRENT (μA) | ORDER OF PROCESS (μA) M | C | Y | BK |
|---|---|---|---|---|---|---|---|
| M | FULL COLOR | | x | 150 | 200 | 250 | 300 |
| | 3 COLORS | | | 150 | 200 | 250 | — |
| | 2 COLORS | (B) | | 150 | 200 | — | — |
| | | (R) | | 150 | — | 180 | — |
| | MONO | (M) | | 150 | — | — | — |
| C | 2 COLORS | (G) | y | — | 150 | 200 | — |
| | MONO | (C) | | — | 150 | — | — |
| Y | MONO | (Y) | z | — | — | 150 | — |
| BK | MONO | (M) | w | — | — | — | 150 |

The output of the CPU 510 is supplied to a digital-analog converter 510 through the input-output device 512, and it is converted to an analog signal. It is then, supplied to the high voltage source 514, and a high voltage output providing the attraction current for each of the mode is supplied to the attraction charger 19.

The method of the potential control will be described. The attraction charging operation is effected with a predetermined attraction current, and the transfer material is supplied. When the transfer material passes by the potential sensor 10a–10d, the surface potential thereof is measured. This is effected for two attraction currents (A, B). This is shown in a graph of FIG. 5. In this graph, target potential S is indicated by a broken line. The measurement results are shown in Table 6, in which $V_MA$, $V_MB$, $V_CA$, $V_CB$, $V_YA$, $V_YB$, $V_KA$ and $V_KB$ are replaced with the results of the potential measurements.

TABLE 6

| FIRST STATION | POTENTIAL MEASUREMENT ATTRACTION CURRENT A | ATTRACTION CURRENT B | TARGET POTENTIAL | DETERMINED ATTRACTION CURRENT |
|---|---|---|---|---|
| M | $V_MA$ | $V_MB$ | S | x |
| C | $V_CA$ | $V_CB$ | S | y |
| Y | $V_YA$ | $V_YB$ | S | z |
| BK | $V_KA$ | $V_KB$ | S | w |

Then, the attraction current are determined for the target potential, using the following proportional equation:

(attraction charger current for providing the target potential)/(target potential) =((the first attraction charger current upon the potential measurement)−(the second attraction charger current upon the potential measurement))/((transfer material potential with the first attraction charger current)−(transfer material potential with the second attraction charger current))

In other words:

$$x=(B-A)S/V_MB-V_MA$$

$$y=(B-A)S/V_CB-V_CA$$

$$z=(B-A)S/V_YB-V_YA$$

$$w=(B-A)S/V_KB-V_KA$$

Thus, the attraction currents for the respective modes are determined, and the determined currents replace x, y, z and w in Table 5. They are produced in the copying operation.

By doing so, as described in conjunction with the first embodiment, the transfer material surface potential immediately before entering the first image forming operation determined by the selected mode is controlled so as to be constant, and therefore, the transfer current in the first image forming operation on the transfer material are common to all modes.

Table 7 below shows examples of the measurements and the target potentials in the potential control and results of calculations.

TABLE 7

| FIRST STATION | POTENTIAL MEASUREMENT A 300 μA | B 50 μA | TARGET POTENTIAL (KV) | DETERMINED ATTRACTION CURRENT (μA) |
|---|---|---|---|---|
| M | 2.0 (KV) | 0.5 (KV) | 1.4 | 320 |
| C | 1.5 | 0.4 | 1.4 | 320 |
| Y | 1.2 | 0.3 | 1.4 | 390 |
| BK | 1.1 | 0.3 | 1.4 | 440 |

In the foregoing embodiments, four image forming stations are used in an electrophotographic type color copying machines. The present invention is applicable to various image forming machines including copying machines and printers of electrophotographic type or electrostatic recording type having plural image forming stations.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

first and second image bearing members;

movable carrying means for carrying a transfer material through a first transfer position for electrostatically transferring a first image from said first image bearing member to the transfer material and through a second transfer position, downstream of the first transfer position with respect to a movement direction of said carrying means, for electrostatically transferring a second image from said second image bearing member onto the transfer material;

wherein said apparatus is operable in a first mode wherein the images are transferred onto the transfer material both at the first and second transfer positions and in a second mode wherein no image is transferred onto the transfer material at the first transfer position, and the image is transferred onto the transfer material at the second transfer position;

wherein difference in surface potentials of the transfer material immediately before and after the transfer material passes through the first transfer position in the first mode and the second transfer position in the second mode, are substantially the same.

2. An apparatus according to claim 1, further comprising electric charge application means for applying electric charge to said carrying means at a position upstream of the first transfer position.

3. An apparatus according to claim 2, wherein said charge application means is effective to electrostatically attract the transfer material onto the carrying means.

4. An apparatus according to claim 2 or 3, wherein an output of said charge application means is different in the first mode than in the second mode so that the surface potential differences are substantially the same.

5. An apparatus according to claim 4, wherein the output of said charge application means is larger in the second mode than in the first mode.

6. An apparatus according to claim 1, further comprising first transfer charging means for transferring the image from said first image bearing member to the transfer material at the transfer position, and second transfer charging means for transferring the image from said second image bearing member onto the transfer material at the second transfer position.

7. An apparatus according to claim 1, wherein an output of said first and second transfer charging means are different so that the surface potential differences are substantially the same.

8. An apparatus according to claim 7, wherein an output of the first transfer charging means in the first mode is larger than the output of the second transfer charging means in the second mode.

9. An apparatus according to claim 2, further comprising first transfer charging means for transferring the image from said first image bearing member to the transfer material at the transfer position, and second transfer charging means for transferring the image from said second image bearing member onto the transfer material at the second transfer position.

10. An apparatus according to claim 9, wherein said charge application means is effective to electrostatically attract the transfer material onto the carrying means.

11. An apparatus according to claim 9 or 10, wherein an output of said charge application means is different in the first mode than in the second mode, and output of the first transfer charging means in the second mode and the second transfer charging means in the second mode are substantially the same, so that the potential difference is substantially the same.

12. An apparatus according to claim 11, wherein an output of said charge application means is larger in the second mode than in the first mode.

13. An apparatus according to claim 9 or 10, wherein an output of said charge application means is substantially the same in the first, mode and in the second mode, and an output of said first transfer charging means in the first mode is different from an output of said second transfer charging means in the second mode, so that the surface potential differences are substantially the same.

14. An apparatus according to claim 13, wherein an output of said first transfer charging means in the first mode is larger than an output of said second transfer charging means in the second mode.

15. An apparatus according to claim 1, 2, 6 or 9, wherein the first transfer position in the first mode and the second transfer position in the second mode are the positions where image transfer operation is first effected on the transfer material.

16. An apparatus according to claim 1, 2, 6 or 9, wherein said carrying means has a transfer material carrying surface having a volume resistivity of $10^{10}-10^{15}$ ohm.cm.

17. An apparatus according to claim 1, wherein said carrying means is in the form of a belt.

18. An apparatus according to claim 1, wherein said apparatus is capable of forming full-color images on the transfer material.

19. An apparatus according to claim 1, further comprising a third image bearing member, wherein said carrying means carries the transfer material to a third image transfer position in which an image is electrostatically transferred from said third image bearing member onto the transfer material at a position downstream of the second transfer position, and wherein differences in the surface potentials of the transfer material immediately before and immediately after the transfer material first passes a transfer position where the transfer material first receives the image are substantially the same, irrespective of a selected mode.

20. An apparatus according to claim 19, further comprising a fourth image bearing member, wherein said carrying means carries the transfer material to a fourth image transfer position in which an image is electrostatically transferred from said fourth image bearing member onto the transfer material at a position downstream of the third transfer position, and wherein differences in the surface potentials of the transfer material immediately before and immediately after the transfer material first passes a transfer position where the transfer material first receives the image are substantially the same, irrespective of a selected mode.

21. An image forming apparatus, comprising:

first and second image bearing members;

movable carrying means for carrying a transfer material through a first transfer position for electrostatically transferring a first image from said first image bearing member to the transfer material and through a second transfer position, downstream of the first transfer position with respect to a movement direction of said carrying means, for electrostatically transferring a second image from said second image bearing member onto the transfer material;

wherein said apparatus is operable in a first mode wherein the images are transferred onto the transfer material both at the first and second transfer positions and in a second mode wherein no image is transferred onto the transfer material at the first transfer position, and the image is transferred onto the transfer material at the second transfer position; and charge application means, disposed upstream of the first transfer position, for applying electric charge to said carrying means, wherein an output of said charge application means is different in the first mode than in the second mode.

22. An apparatus according to claim 21, wherein said charge application means is effective to electrostatically attracts the transfer material onto said carrying means.

23. An apparatus according to claim 21 or 22, wherein an output of said charge application means is larger in the second mode than in the first mode.

24. An apparatus according to claim 21, further comprising first transfer charging means for transferring the image from said first image bearing member to the transfer material at the transfer position, and second transfer charging means for transferring the image from said second image bearing member onto the transfer material at the second transfer position.

25. An apparatus according to claim 24, wherein an output of said first transfer charging means in the first mode is substantially the same as an output of said second transfer charging means in the second mode.

26. An apparatus according to claim 21, wherein the first transfer position in the first mode and the second transfer position in the second mode are the positions where image transfer operation is first effected on the transfer material.

27. An apparatus according to claim 21, wherein said carrying means has a transfer material carrying surface having a volume resistivity of $10^{10}-10^{15}$ ohm.cm

28. An apparatus according to claim 21, wherein said carrying means is in the form of a belt.

29. An apparatus according to claim 21, wherein said apparatus is capable of forming full-color images on the transfer material.

30. An apparatus according to claim 21, further comprising a third image bearing member, wherein said carrying means is effective to carry the transfer material to a third transfer position where an image is electrostatically transferred from said third image bearing member onto the transfer material, wherein the third transfer position is downstream of the second transfer position, and wherein an output of said charge application means is larger if a distance between said charge application means and a first transfer position where the transfer material first receives the image is larger.

31. An apparatus according to claim 30, further comprising a fourth image bearing member, wherein said carrying means is effective to carry the transfer material to a fourth transfer position where an image is electrostatically transferred from said fourth image bearing member onto the transfer material, wherein the fourth transfer position is downstream of the third transfer position, and wherein an output of said charge application means is larger if a distance between said charge application means and a first transfer position where the transfer material first receives the image is larger.

32. An image forming apparatus, comprising:

first and second image bearing members;

movable carrying means for carrying a transfer material through a first transfer position for electrostatically transferring a first image from said first image bearing member to the transfer material and through a second transfer position, downstream of the first transfer position with respect to a movement direction of said carrying means, for electrostatically transferring a second image from said second image bearing member onto the transfer material;

wherein said apparatus is operable in a first mode wherein the image is transferred onto the transfer material at the first transfer position, but no image is transferred onto the transfer material at the second transfer position, and is operable in a second mode wherein no image is transferred onto the transfer material in the first transfer position and the image is transferred onto the transfer material at the second transfer position;

charge application means, disposed upstream of the first transfer position, for applying electric charge to said carrying means, wherein an output of said charge application means is different in the first mode than in the second mode.

33. An apparatus according to claim 32, wherein said charge application means is effective to electrostatically attracts the transfer material onto said carrying means.

34. An apparatus according to claim 32 or 33, wherein an output of said charge application means is larger in the second mode than in the first mode.

35. An apparatus according to claim 32, further comprising first transfer charging means for transferring the image from said first image bearing member to the transfer material at the transfer position, and second transfer charging means for transferring the image from said second image bearing member onto the transfer material at the second transfer position.

36. An apparatus according to claim 35, wherein an output of said first transfer charging means in the first mode is substantially the same as an output of said second transfer charging means in the second mode.

37. An apparatus according to claim 32, wherein the first transfer position in the first mode and the second transfer position in the second mode are the positions where image transfer operation is first effected on the transfer material.

38. An apparatus according to claim 32, wherein said carrying means has a transfer material carrying surface having a volume resistivity of $10^{10}-10^{15}$ ohm.cm

39. An apparatus according to claim 32, wherein said carrying means is in the form of a belt.

40. An apparatus according to claim 32, wherein said apparatus is capable of forming full-color images on the transfer material.

41. An apparatus according to claim 32, further comprising a third image bearing member, wherein said carrying means is effective to carry the transfer material to a third transfer position where an image is electrostatically transferred from said third image bearing member onto the transfer material, wherein the third transfer position is downstream of the second transfer position, and wherein an output of said charge application means is larger if a distance between said charge application means and a first transfer position where the transfer material first receives the image is larger.

42. An apparatus according to claim 41, further comprising a fourth image bearing member, wherein said carrying means is effective to carry the transfer material to a fourth transfer position where an image is electrostatically transferred from said fourth image bearing member onto the transfer material, wherein the fourth transfer position is downstream of the third transfer position, and wherein an output of said charge application means is larger if a distance between said charge application means and a first transfer position where the transfer material first receives the image is larger.

43. An image forming apparatus, comprising:

first and second image bearing members;

carrying means for carrying a transfer material to a first transfer position and a second transfer position which is disposed downstream of the first transfer position with respect to a movement direction of the transfer material;

first transfer means for electrostatically transferring an image from said first image bearing member onto the transfer material at the first transfer position;

second transfer means for electrostatically transferring an image from said second image bearing member to the transfer material at a second transfer position;

wherein said apparatus is operable in a first mode wherein the images are transferred onto the transfer material at the first and second transfer positions by the first and second transfer means, and is operable in a second mode in which no image is transferred onto the transfer material at the first transfer position, and the image is transferred onto the transfer material at the second transfer position by said second transfer means;

wherein an output of said first transfer means in the first mode is different from an output of said second transfer means in the second mode.

44. An apparatus according to claim 43, further comprising charge application means, disposed upstream of the first transfer position, for applying electric charge to said carrying means.

45. An apparatus according to claim 44, wherein said charge application means is effective to electrostatically attract the transfer material onto said carrying means.

46. An apparatus according to claim 43, wherein an output of said first>transfer means in the first mode is larger than an output of said second transfer charging means in the second mode.

47. An apparatus according to claim 44, wherein outputs of said charge application means in the first mode in the second mode are substantially the same.

48. An apparatus according to claim 43, wherein the first transfer position in the first mode and the second transfer position in the second mode are the positions where image transfer operation is first effected on the transfer material.

49. An apparatus according to claim 43, wherein said carrying means has a transfer material carrying surface having a volume resistivity of $10^{10}-10^{15}$ ohm.cm.

50. An apparatus according to claim 43, wherein said carrying means is in the form of a belt.

51. An apparatus according to claim 43, wherein said apparatus is capable of forming full-color images on the transfer material.

52. An apparatus according to claim 43, further comprising a third image bearing member and third transfer means for electrostatically transferring an image from said third image bearing member onto the transfer material at a third image transfer position downstream of said second transfer position, wherein an output of transfer means is larger at an upstream transfer position where the transfer material first receives the image.

53. An apparatus according to claim 52, further comprising a fourth image bearing member and fourth transfer means for electrostatically transferring an image from said fourth image bearing member onto the transfer material at a fourth image transfer position downstream of said third transfer position, wherein an output of transfer means is larger at an upstream transfer position where the transfer material first receives the image.

54. An image forming apparatus, comprising:

first and second image bearing members;

carrying means for carrying a transfer material to a first transfer position and a second transfer position which is disposed downstream of the first transfer position with respect to a movement direction of the transfer material;

first transfer means for electrostatically transferring an image from said first image bearing member onto the transfer material at the first transfer position;

second transfer means for electrostatically transferring an image from said second image bearing member to the transfer material at a second transfer position;

wherein said apparatus is operable in a first mode wherein the image is transferred onto the transfer material at the first transfer position by said first transfer means, and no image is transferred at the second transfer position, and is operable in a second mode in which no image is transferred onto the transfer material at the first transfer position, and the image is transferred onto the transfer material at the second transfer position by said second transfer means;

wherein an output of said first transfer means in the first mode is different from an output of said second transfer means in the second mode.

55. An apparatus according to claim 54, further comprising charge application means, disposed upstream of the first transfer position, for applying electric charge to said carrying means.

56. An apparatus according to claim 55, wherein said charge application means is effective to electrostatically attract the transfer material onto said carrying means.

57. An apparatus according to claim 54, wherein an output of said first transfer means in the first mode is larger than an output of said second transfer charging means in the second mode.

58. An apparatus according to claim 55, wherein outputs of said charge application means in the first mode in the second mode are substantially the same.

59. An apparatus according to claim 54, wherein the first transfer position in the first mode and the second transfer position in the second mode are the positions where image transfer operation is first effected on the transfer material.

60. An apparatus according to claim 54, wherein said carrying means has a transfer material carrying surface having a volume resistivity of $10^{10}-10^{15}$ ohm.cm.

61. An apparatus according to claim 54, wherein said carrying means is in the form of a belt.

62. An apparatus according to claim 54, wherein said apparatus is capable of forming full-color images on the transfer material.

63. An apparatus according to claim 54, further comprising a third image bearing member and third transfer means for electrostatically transferring an image from said third image bearing member onto the transfer material at a third image transfer position downstream of said second transfer position, wherein an output of transfer means is larger at an upstream transfer position where the transfer material first receives the image.

64. An apparatus according to claim 63, further comprising a fourth image bearing member and fourth transfer means for electrostatically transferring an image from said fourth image bearing member onto the transfer material at a fourth image transfer position downstream of said third transfer position, wherein an output of transfer means is larger at an upstream transfer position where the transfer material first receives the image.

* * * * *

UNITED STATES PATENT AND TRADEMARK OFFICE

CERTIFICATE OF CORRECTION

PATENT NO. 5,187,536

DATED February 16, 1993

INVENTOR(S) TAKASHI HASEGAWA, ET AL.

It is certified that error appears in the above-indentified patent and that said Letters Patent is hereby corrected as shown below:

COLUMN 1

Line 26, "a" should be deleted.

Line 57, "This arises the fol-" should read --Thus the following problems arise.--

Line 58, "lowing problems." should be deleted.

COLUMN 4

Line 36, "material" should read --material is--.

COLUMN 7

Line 27, "$\neq V_m$" should read --$\Delta V_m$--.

Line 33, "90%" should read --90%.--.

COLUMN 9

Line 32, "outputs" should read --output--.

COLUMN 10

Line 56, "a" should be deleted.

UNITED STATES PATENT AND TRADEMARK OFFICE

CERTIFICATE OF CORRECTION

PATENT NO. 5,187,536

DATED February 16, 1993

INVENTOR(S) TAKASHI HASEGAWA, ET AL.

It is certified that error appears in the above-indentified patent and that said Letters Patent is hereby corrected as shown below:

COLUMN 11
Line 32, "CPU 510 effect" should read --CPU 510 through an input port 507. The CPU 510 effects--.

COLUMN 14
Line 11, "first," should read --first--.

COLUMN 15
Line 18, "attracts" should read --attract--.

COLUMN 16
Line 28, "attracts" should read --attract--.

COLUMN 17
Line 45, "first >" should read --first--.
Line 50, "mode in" should read --mode and in--.

Signed and Sealed this

Eighth Day of February, 1994

Bruce Lehman

*Attest:*

BRUCE LEHMAN

*Attesting Officer*

*Commissioner of Patents and Trademarks*